US006044513A

United States Patent [19]

Penn

[11] Patent Number: 6,044,513

[45] Date of Patent: Apr. 4, 2000

[54] MOP APPARATUS ASSEMBLY

[76] Inventor: Margo R. Penn, 2006 Suffolk La., Indianapolis, Ind. 46260

[21] Appl. No.: 09/093,738

[22] Filed: Jun. 8, 1998

[51] Int. Cl.[7] ..... A47L 13/12

[52] U.S. Cl. ..... 15/118; 15/244.1

[58] Field of Search ..... 15/118, 144.4, 15/147.1, 147.2, 228, 244.1, 244.2

[56] References Cited

U.S. PATENT DOCUMENTS

| | | | |
|---|---|---|---|
| 2,517,213 | 8/1950 | Kautenberg | 15/244.1 |
| 3,434,176 | 3/1969 | Cazet | 15/147.1 |
| 3,452,383 | 7/1969 | Eichner | 15/147.1 |
| 3,720,976 | 3/1973 | Bailey | 15/244.2 |
| 5,343,586 | 9/1994 | Vosbikian | 15/244.1 |
| 5,428,858 | 7/1995 | Vartanian | 15/244.1 |
| 5,625,918 | 5/1997 | Kieson | 15/244.1 |
| 5,896,613 | 4/1999 | Courtney et al. | 15/118 |

FOREIGN PATENT DOCUMENTS

| | | | |
|---|---|---|---|
| 2474854 | 8/1981 | France | 15/147.1 |
| 4008716 | 6/1991 | Germany | 15/244.1 |

*Primary Examiner*—Terrence R. Till
*Attorney, Agent, or Firm*—Robert A. Spray

[57] ABSTRACT

A mop apparatus assembly having receptor teeth, and a handle member screwed into the socket. A sponge pick-up head member is carried by the base member by being gripped by the receptor teeth.

Other details are shown and described.

8 Claims, 4 Drawing Sheets

MOP APPARATUS ASSEMBLY

I. FIELD OF THE INVENTION

Figure 1:
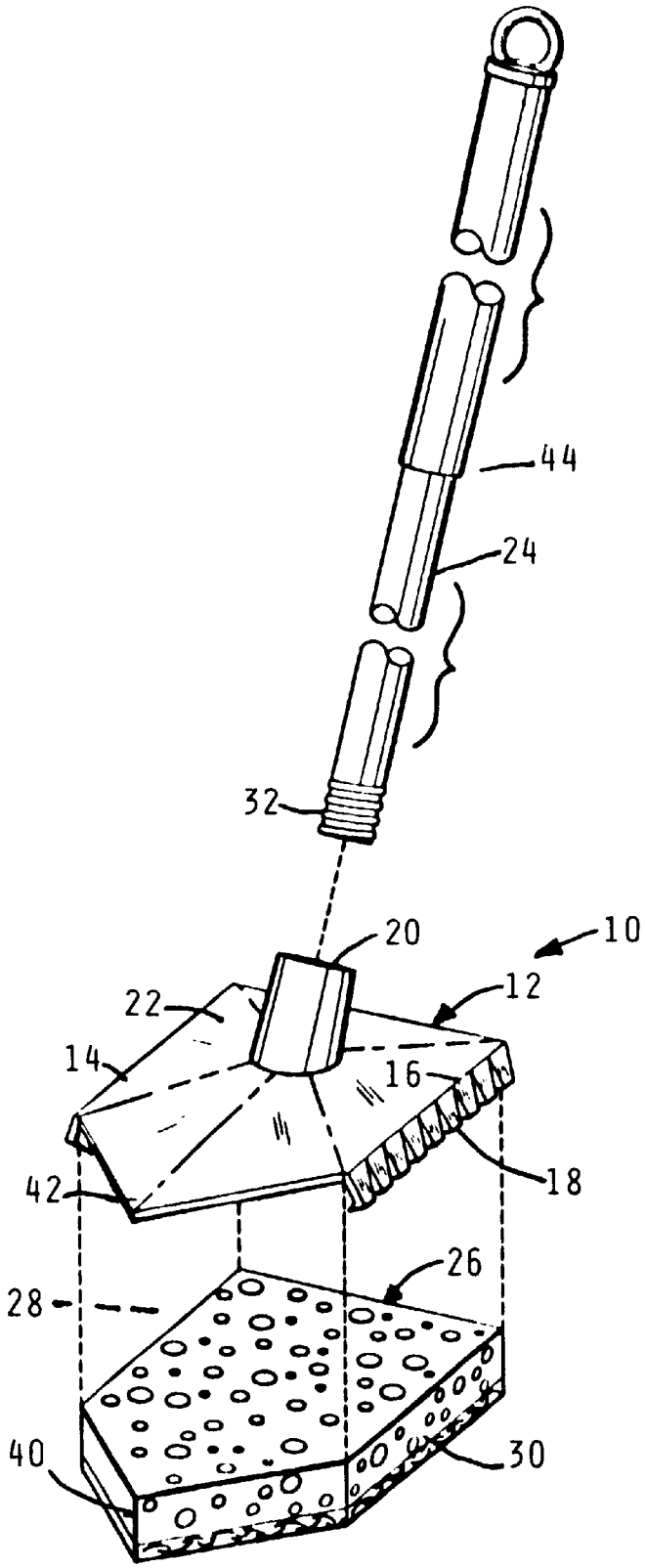

The present invention relates to cleaning apparatus, and more particularly, mop apparatus in the form of a manual tool.

More particularly the invention relates to and provides a mop assembly of special form and nature which is especially useful and convenient for the cleaning of floors, shelves, walls, windows and other surfaces, both residential and commercial buildings being usefully and conveniently cleaned by the mop apparatus.

The mop assembly is particularly useful in cleaning surfaces which contain corners or other similar features which are not easily cleanable by conventional mops.

II. PROBLEMS INHERENT IN PROVIDING CLEANING APPARATUS NEED FOR A VARIETY OF TASKS

Problems which are inherent in the provision of mop tools are solved by the present invention.

For example, most surfaces of both residential and commercial structures contain corners and other "tight" or irregular areas or regions; and conventional mops are not fully satisfactory in being able to achieve thorough cleansing of such spaces or areas.

Also, many mop tools are not convenient with respect to the provision of the way that a sponge pick-up unit is easily attached to the tool, for easy attachment and easy removal, as must be done fairly often in order to attain a thorough cleaning task, and avoiding the use of a dirty mop.

Limitations of storage usually available generally require easy of assembly and disassembly.

Economy goals make desirable a feature of ease of interchange of the sponge pick-up unit.

Another problem of many conventional mop tools is that they are of a fixed length, such that they are inconveniently used on many surfaces which are not readily accessable to the use of the tool.

III. SUMMARY OF THE INVENTION

In the preferred form of this invention, the mop assembly comprises a base member having along both of its sides a set of inwardly facing receptor teeth, and an upwardly open socket member on its upper surface for receiving a handle member which is fixed to the base member's socket.

A sponge pick-up head member is gripped along both of its sides by the sets of teeth, and the receptor teeth and the sponge pick-up head member are of coordinated size and shape such that the sponge pick-up head member must be partially folded to permit it to be placed against the bottom of the base member by an installation movement of the sponge pick-up head member by which the sponge pick-up member passes the sets of receptor teeth.

Preferably as shown, the sponge member and the base member are shaped to provide a pointed forward end of the assembly of the base member and the sponge pick-up head member.

The Drawings illustrate other desired features, as described further in the text.

IV. PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively help to show the non-obviousness of this combination invention. E.g., a. The prior art has long had mop devices of various kinds;

b. The prior art has long known of the unending need for mop apparatus;

c. The prior art has long included millions of persons, the world over, as being persons who personally have used and seen mops and the need for mops;

d. The prior art has long realized the need for utility devices, including mops, to be convenient in all details of their use;

e. The prior art has long known of the desirability to make improvements in utility devices including mops;

f. The prior art of the mop and utility industries has surely supposed or known that many customers and prospective customers would be willing to purchase a mop which achieved greater convenience to the user;

g. Mops are of such negligible cost that large sales would be realistically expected as to most residential and commercial cleaning situations;

h. The relative ease of manufacture and relative simplicity of mops have surely given their manufacturers ample incentive to have made modifications for commercial competitiveness in competitive industry with huge sales prospects reasonably expectable;

i. The prior art has always had sufficient skill to make many types of mops and apparatus for mops, more than ample skill to have achieved the present invention, but only if the concepts and their combinations had been conceived;

j. Substantially all of the operational characteristics and advantages of details of the present invention, when considered separately from one another and when considered separately from the present invention's details and accomplishment of the details, are within the skill of persons of various arts, but only when considered away from the integrated and novel combination of concepts which by their cooperative combination achieves this advantageous invention;

k. The details of the present invention, when considered solely from the standpoint of construction, are relatively simple, and the matter of simplicity of construction has long been recognized as indicative of inventive creativity;

l. The components of this mop assembly are makable by machinery and manufacturing facilities of most industrial enterprises, large and small;

m. The manufacture of these mop assemblies could be without assembly of components, minimizing cost, yet the assembly would be easily within the skill of most purchasers; and n. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate.

Accordingly, although the prior art has had capability and motivation, amply sufficient to presumably give incentive to the development of specialized mop apparatus according to the present invention, the fact remains that the present invention awaited the creativity and inventive discovery of the present inventor. In spite of ample motivation and capability shown by the illustrations herein, the prior art did not suggest this invention.

V. PRIOR ART AS PARTICULAR INSTANCES OF FAILURE TO PROVIDE ADVANTAGEOUS COMBINATION KIT OR ASSEMBLY OF A MOP PROVIDING ADVANTAGES HEREOF

In view of the inherent possibility of a combination device of the nature and advantage of the one of this invention, it is particularly significant that the prior art's continuing development has not achieved the present invention. Further, the persons of sufficient knowledge and skill to have achieved this combination surely include a multitude of manufacturers and users of mop devices and corresponding swabbing procedures, such that this combination invention would have come about if its concepts had been obvious.

Widely known prior art known to the inventor includes mops of string and/or rag type, sponge and/or squeegee, etc., and developments through the years have included various types of wring-out apparatus and other ways to clean the debris off the pick-up or head assembly; and most if not all of the long-continuing and diverse developments have been in recognition of the very problems of convenience, handiness and thoroughness of cleaning effort which are expressly the goals whose challenge is advantageously fulfilled by the present invention.

VI. SUMMARY OF THE PRIOR ART'S LACK SUGGESTIONS OF THE CONCEPTS OF THE INVENTION'S COMBINATION

In spite of all such factors of the prior art, the problem here solved awaited this inventor's present creativity. More particularly as to the novelty here of the invention as considered as a whole, the candid reference to the prior art uses and needs helps to show its contrast to the present concepts, and emphasizes the advantages, novelty, and the inventive significance of the present concepts as are here shown, particularly as to utility, economy and convenience of use as detailed herein.

Moreover, prior art articles known to this inventor which could possibly be adapted for this duty fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination, of the invention as considered as a whole, a contrast to the prior art helps also to remind both the variety of the various prior art articles and needed attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier seen as an invention.

Although varieties of prior art are conceded, and ample motivation is shown, and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a handy and convenient mop assembly or kit which achieves the useful advantages and helpfulness to the cleaning operator of the present invention, which are goals only approached by the prior art, must be recognized as being a long-felt need now fulfilled.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VII. BRIEF DESCRIPTION OF THE DRAWINGS

Figure 2:
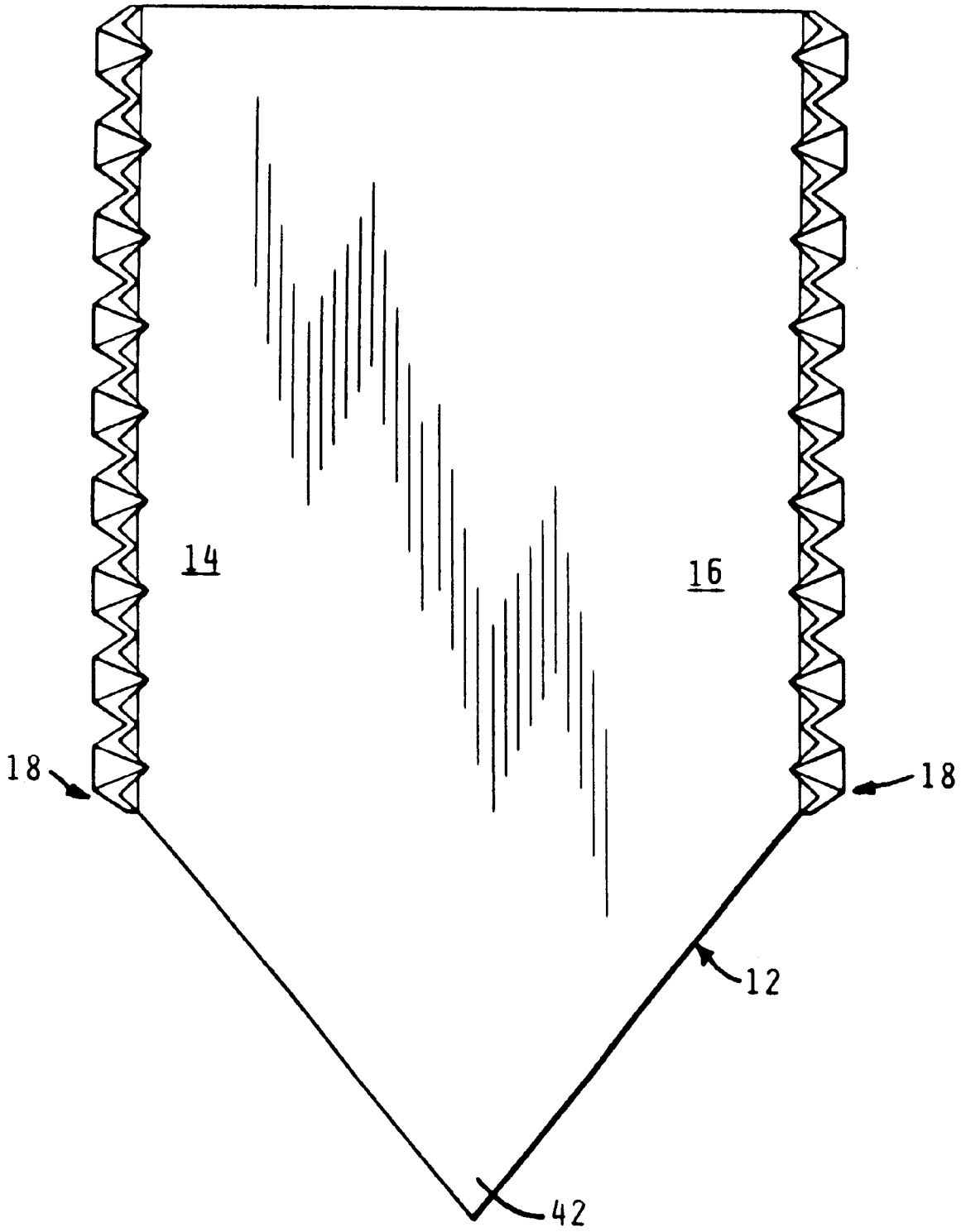
Figure 3:
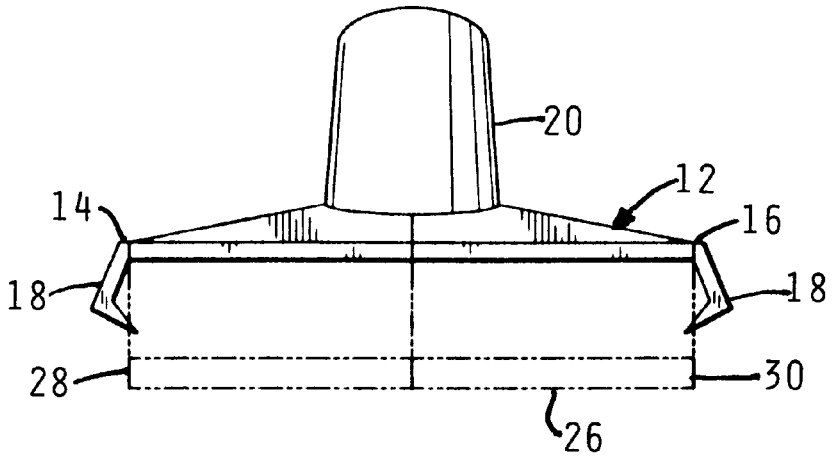
Figure 4:
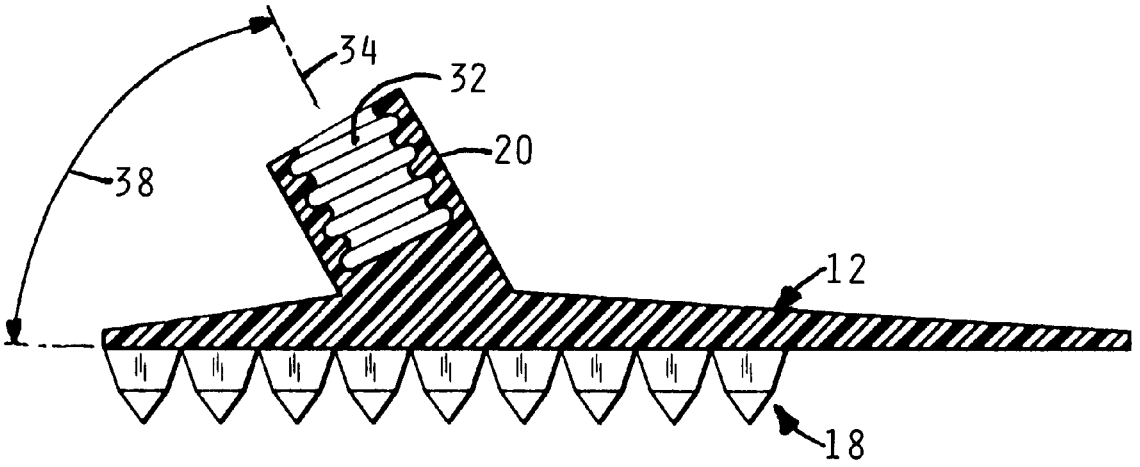

The above description of the novel and advantageous invention is of somewhat introductory and generalized form. More particular details, concepts, and features are set forth in the following and more detailed description of an illustrative embodiment, taken in conjunction with the accompanying Drawings, which are of somewhat schematic and diagrammatic nature for showing the inventive concepts; and in the Drawings:

FIG. 1 is a pictorial view of the mop of the present invention, the handle and the sponge pick-up head member being shown in a so-called exploded view with respect to the base member;

FIG. 2 in enlarged scale is a bottom view of the base member of the unit shown in FIG. 1;

FIG. 3, in smaller scale is an elevation view of the base member, with the sponge pick-up member shown in chain lines;

FIG. 4 is a longitudinal cross-sectional view of the base member; and

Figure 5:
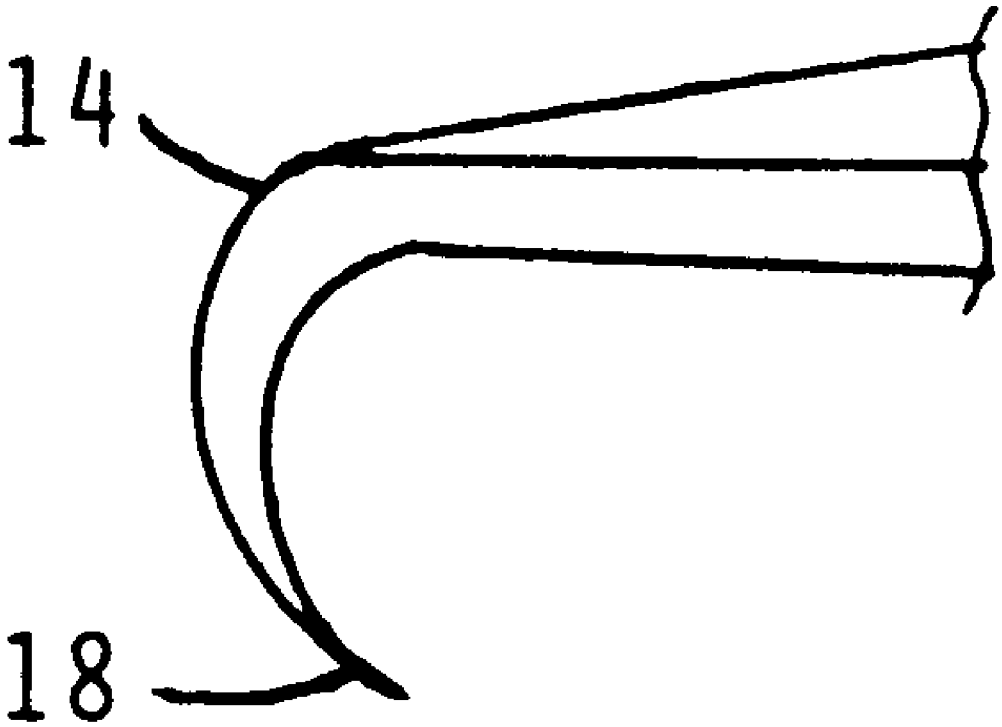

FIG. 5, in somewhat enlarged scale, is a detail view illustrating a preferred form of the teeth in comparison to FIG. 3.

VIII. DETAILED DESCRIPTION OF PREFERRED EMBODIMENT

As shown in the Drawings, the concepts provide a novel and advantageous mop apparatus in the form of an assembly 10. As most completely shown in FIG. 1, the apparatus 10 comprises only four basic features, as now described; but they cooperate to provide this mop 10 of handy and novel nature.

There is provided a base member 12 having opposed sides 14/16; and the base member 12 has along each of its sides 14/16 a set of inwardly facing receptor teeth 18. The base member 12 has an upwardly open socket member 20 on its upper surface 22.

For manipulation of the apparatus 10, there is provided a handle member 24 which is affixable to the base member 12 by releasable engagement with the socket member 20.

For the operativity of wetting the associated surface to be cleaned, and to soak up the dirty water from the surface, there is provided a sponge pick-up head member 26 which is to be carried by the base member 12; and as shown the sponge head member 26 is operatively and releasably gripped along both of its sides 28/30 by the respective sets of receptor teeth 18. Sets 18 and the sponge pick-up head member 26 are of coordinated size and shape, i.e., coordinated such that the sponge pick-up head member 26 must be partially folded to permit it to be placed against the bottom of the base member 12 by an installation movement of the sponge pick-up head member 26 by which it passes the sets of receptor teeth 18. Correspondily, the sponge member 26 is to be partially folded to permit it to be removed from the teeth 18 and the base member 12.

In describing the pick-up head member 26 as a "sponge", the word "sponge" is used in a broadly descriptive sense of a natural or artificial body which has the characteristics of being able to be easily resiliently deformed, quite porous and bendable, and operative by a squeezing effort to be both bent and to perform a sponge-like duty in carrying the cleansing liquid and serving as a multi-chamber "pick-up" pump.

The apparatus 10 in its preferred form has other features of advantage, which add to the cooperative combination by which the apparatus 10 is achieved.

For example, as shown, the socket member 20 and the handle member 24 are made releasably engageable by screw threads 32 which are shown as cooperatively provided on both the handle member 24 and the socket member 20.

Further as to the handle member 24 and socket member 20 and base member 12, especially as shown in FIG. 4, the socket member 20 is provided to be on an axis 34 such that when the handle member 24 is affixed to the socket member 20 the handle member 24 extends as indicated by reference number 38 about 60° from the plane of the base member 12.

A special advantage of the apparatus 10 in its preferred form is the ability to access and accommodate thorough cleaning of surfaces meeting in a corner; and providing this advantage the forward end 40 of the sponge pick-up head member 26 and the forward end 42 of the base member 12 are shaped to provide a pointed forward end 40/42 of the assembly of the base member 12 and the sponge pick-up head member 26.

For further advantage and utility, the sponge pick-up head member 26 is preferably to be of differing texture on its upper and lower faces, providing for the user's optional choice of operativity in use, by selection of one or the other of the faces of the sponge pick-up head member 26 to be exposed in installation of the assembly 10.

Further advantage of the combination, as schematically noted in FIG. 1, the handle member 24 is provided to be of telescoping nature 44, giving the user the optional choice of length of the handle member 24 during use of the assembly 10.

The assembly 10 further takes advantage of sponge nature of the pick-up head 26 as being formed of resiliently deformable material. More particularly, this nature permits that it may be of a relatively greater dimension for being gripped by the receptor teeth 18 (See FIGS. 3 & 5) and of relatively lesser dimension (by folding) permitting it to be released from the teeth 18. Of the two forms of receptor teeth 18 to show the concepts, the inventor prefers the form more like the teeth 18 shown in FIG. 5; although the inventive concepts are not limited to a precise geometrical formation of the components.

Economy is preferably provided by making the base member 12, the socket 20, and the receptor teeth sets 18 to be provided as integral components of the assembly.

IX. CONCLUSION AS TO INVENTIVE COMBINATION

It is thus seen that a special mop device, formed according to the combination of inventive concepts and details herein set forth, provides novel concepts of a desirable and usefully advantageous article, yielding advantages which are and which provide special and particular advantages when used for a mop device particularly advantageous for general and specialized mop duties, such as, e.g., a utility mop for handy and convenient use in hospitality/healthcare facilities for floor and wall cleaning, more convenient, handy, and environmentally safe than other mops.

In summary as to the nature of the overall mop device's advantageous concepts, their novelty and inventive combination is shown by novel features of concept and procedure shown here in advantageous combination and by the novel combinations hereof not only being different from all prior art known, even though many other mop devices of conventional and specialized types have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of mop devices for a great number of years throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of mop devices.

The differences of concept, of construction and procedure, yield advantages over the prior art; and the lack of this invention by the prior art, as an inventive combination, has been in spite of this invention's apparent simplicity of the construction once the concepts have been conceived, in spite of the advantages it would have given, and in spite of the availability of all of the materials to all persons of the entire world, and the invention's relatively non-technical and openly-visible nature.

Quite certainly this particular combination of prior art details as here presented in this overall combination has not been suggested by the prior art, this achievement in its particular details and utility being a substantial and advantageous departure from prior art, even though the prior art has had somewhat similar components separately for numbers of years.

Particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art of mop device articles not achieving particular advantages here achieved by this combination.

Accordingly, it will thus be seen from the foregoing description of the invention according to the illustrative embodiment, considered with the accompanying Drawings, that the present invention provides new and useful concepts of a novel and advantageous article, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

What is claimed is:

1. A mop apparatus assembly, comprising, in combination:

a base member having opposed sides, and having along each of its sides a set of inwardly facing receptor teeth, and provided with an upwardly open socket member on its upper surface;

a handle member affixable to the base member by releasable engagement with the socket member;

a sponge pick-up head member to be carried by the base member by being operatively and releasably gripped along both of its sides by the respective sets of receptor teeth;

and the sets of receptor teeth and the sponge pick-up head member being of coordinated size and shape such that the sponge pick-up head member must be partially folded to permit it to be placed against the bottom of the base member by an installation movement of the sponge pick-up head member by which the sponge pick-up head member passes the sets of receptor teeth, and partially folded to permit it to be removed therefrom, in a combination in which the forward end of the sponge pick-up head member and the base member are shaped to provide a pointed forward end of the assembly of the base member and the sponge pick-up head member.

2. A mop apparatus assembly, comprising, in combination:

a base member having opposed sides, and having along each of its sides a set of inwardly facing receptor teeth, and provided with an upwardly open socket memberon its upper surface;

a handle member affixable to the base member by releasable engagement with the socket member;

a sponge pick-up head member to be carried by the base member by being operatively and releasably gripped along both of its sides by the respective sets of receptor teeth;

and the sets of receptor teeth and the sponge pick-up head member being of coordinated size and shape such that the sponge pick-up head member must be partially folded to permit it to be placed against the bottom of the base member by an installation movement of the sponge pick-up head member by which the sponge pick-up head member passes the sets of receptor teeth, and partially folded to permit it to be removed therefrom, in a combination in which the sponge pick-up head member is provided to be of differing texture on its upper and lower faces, providing for the user's optional choice of operativity in use, by selection of one or the other of the faces of the sponge pick-up head member to be exposed in installation of the assembly.

3. A mop apparatus assembly, comprising, in combination:

a base member having opposed sides, and having along each of its sides a set of inwardly facing receptor teeth, and provided with a handle member on its upper side;

a sponge pick-up head member to be carried by the base member by being operatively and releasably gripped along both of its sides by the respective sets of receptor teeth;

and the sets of receptor teeth and the sponge pick-up head member being of coordinated size and shape such that the sponge pick-up head member must be partially folded to permit it to be placed against the base member teeth and retained thereby or removed therefrom;

in a combination in which the forward end of the sponge pick-up head member and the base member are shaped to provide a pointed forward end of the assembly of the base member and the sponge pick-up head member.

4. A mop apparatus assembly according to claim 3, in a combination in which the teeth of each set are closely adjacent one another, and are sharply pointed for achieving firm grasp of the sponge pick-up head member.

5. A mop apparatus assembly according to claim 3, in a combination in which the handle member is located generally centrally of the upper surface of the base member.

6. A mop apparatus assembly, comprising, in combination:

a base member having opposed sides, and having along each of its sides a set of inwardly facing receptor teeth, and provided with a handle member on its upper side;

a sponge pick-up head member to be carried by the base member by being operatively and releasably gripped along both of its sides by the respective sets of receptor teeth;

and the sets of receptor teeth and the sponge pick-up head member being of coordinated size and shape such that the sponge pick-up head member must be partially folded to permit it to be placed against the base member teeth and retained thereby or removed therefrom;

in a combination in which the sponge pick-up head member is provided to be of differing texture on its upper and lower faces, providing for the user's optional choice of operativity in use, by selection of one or the other of the faces of the sponge pick-up head member to be exposed in installation of the assembly.

7. A mop apparatus assembly according to claim 6, in a combination in which the teeth of each set are closely adjacent one another, and are sharply pointed for achieving firm grasp of the sponge pick-up head member.

8. A mop apparatus assembly according to claim 6, in a combination in which the handle member is located generally centrally of the upper surface of the base member.

* * * * *